US005372316A

United States Patent [19]

Bateman

[11] Patent Number: 5,372,316

[45] Date of Patent: Dec. 13, 1994

[54] WASTE PROCESSING MACHINE

[75] Inventor: Ivor Bateman, Mount Pleasant, Mich.

[73] Assignee: Tramor, Inc., Remus, Mich.

[21] Appl. No.: 70,295

[22] Filed: Jun. 2, 1993

Related U.S. Application Data

[60] Division of Ser. No. 942,741, Sep. 9, 1992, abandoned, which is a continuation-in-part of Ser. No. 874,751, Apr. 27, 1992, abandoned.

[51] Int. Cl.[5] ..... B02C 13/10

[52] U.S. Cl. ..... 241/191; 241/244

[58] Field of Search ..... 241/191, 194, 247, 244

[56] References Cited

U.S. PATENT DOCUMENTS

| | | | |
|---|---|---|---|
| 2,145,728 | 1/1939 | Mankoff | 241/191 X |
| 2,873,921 | 2/1959 | Christiansen | 241/191 X |
| 2,996,260 | 8/1961 | Carder | 241/191 |
| 3,139,917 | 7/1964 | Elmore | 241/191 |
| 4,081,146 | 3/1978 | Yagi | 241/244 X |
| 5,044,567 | 9/1991 | Hte et al. | 241/186.3 X |

*Primary Examiner*—Richard K. Seidel
*Assistant Examiner*—Kenneth E. Peterson
*Attorney, Agent, or Firm*—Varnum, Riddering, Schmidt & Howlett

[57] ABSTRACT

The invention is a waste processor which incorporates the advantages of the chipper knife holder 100, swing hammers 50 and hog 120. A swing hammer 54 is used, providing for the use of all the kinetic energy stored in the swing hammers 54 together with good material contact. The swing hammer 54 profile is designed to spread the impact force over a large area, thus increasing the life of the swing hammer 54. If necessary, the swing hammers 50 can be locked to the rotating disk assembly 18, preventing their contacting any material. Hog hammers 120 are placed immediately behind the swing hammers 50. The position of the hog hammers 120 is such that they provide room for the swing hammers 50 to recoil, but are close enough to impact the material in approximately the same place as the swing hammers 50. The hog hammers 120 use the much larger amount of kinetic energy that is stored in the rotating disk assembly 18. The disks have material guides 158 at their outer periphery for directing the mulch material laterally to prevent the mulch material from accumulating at the periphery of each disk 40 and between the disks 40. A choke plate 156 provides for altering the size of the outlet opening during operation of the waste processor to substantially control the size of the particle expelled from the waste processor.

11 Claims, 10 Drawing Sheets

WASTE PROCESSING MACHINE

This is a division, of application Ser. No. 07/942,741 filed Sep. 9, 1992, now abandoned, which is a continuation-in-part of application Ser. No. 07/874,751 filed Apr. 27, 1992 now abandoned.

BACKGROUND OF THE INVENTION

1. Field of the Invention

This invention relates to a waste processing machine; more specifically, to a waste processing machine incorporating a combination chipper, swing hammer and hog hammer.

2. Description of the Related Art

A variety of devices are provided to comminute and chip discarded waste products. Currently, four types of equipment are generally used for this purpose: chippers (disk and drum types), hammer mills, hogs and shredders. Shredders operate much slower than the other three types and are more suited for processing metals and rubber products.

Chippers are generally constructed around a rotating disk or drum. The chippers mount a plurality of blades to the rotating disk or drum and shear the wood products into chips. Hammer mills are generally constructed around a plurality of rotating disks having a plurality of free-swinging hammers attached at the periphery of each disk, providing for the transferring of a portion of the kinetic energy stored in the rotating disks to the wood products through the rotating hammers. Hogs are similar to hammer mills except that the hammers are rigidly secured to the periphery of the rotating disks. Hogs may also be constructed with a drum.

Of chippers, hammer mills and hogs, chippers are generally much more efficient, requiring less horsepower to chip the material while simultaneously being more productive. Chippers can chip logs and trees up to 40 inches in diameter, as well as small brush. They are also used to produce a dimensionally similar chip for the paper industry. A major disadvantage of chippers is that they require reasonably "clean" wood in order for the chipper knives to remain sharp. Any foreign material such as nails, spikes, rocks and sand will quickly dull the knife cutting edge. For this reason, chippers are not suited for reducing wood waste such as pallets, construction refuse or paper products.

A hammer mill will break up pallets, paper products, construction materials and small tree branches. The kinetic energy stored in the free-swinging hammers is used to break up the material. Because the hammers do not have the same requirement for sharp edges as chipper knives, dirty material is easily processed by a hammer mill. A hammer mill also has the advantage that the rotatable hammers will recoil backwardly if the hammer cannot break the material on impact. This built-in safety feature permits the hammers to protrude several inches beyond the disks that support them, making it possible for the hammers to make good contact with the material.

However, a known disadvantage of the hammer mill is that the size of the free-swinging hammers is limited. The hammers rely on centrifugal force to hold them in a radially outward position ready for impact. Upon impact, they may swing back rapidly which produces an unbalancing force on the mill. If the hammer mill turns too fast or the hammers are too heavy, a large vibration will occur. For this reason, the amount of kinetic energy that can be stored in the free-swinging hammers is limited. This, in turn, limits the size of the logs being processed to approximately 6 inches in diameter.

A hog is similar to a hammer mill except that the hog hammers are fixed to the disks or drum and do not rotate relative to the disk assembly. The hog has two advantages over the hammer mill. First, the disk assembly or drum always remains balanced because the hog hammers do not swing. Second, the hog hammer uses the full kinetic energy that is stored in the rotating disk assembly or drum to do the work on the waste products. Normally, the stored energy in the disk assembly or drum is far greater than the stored energy in the free-swinging hammers. Typically, logs up to eight or 9 inches in diameter can be processed with a hog. The upper limit is dictated by the amount of power available and the structural limits of the hog assembly.

Because hog hammers are rigidly attached to the disk assembly or drum, there is a greater possibility of damaging the machine when the hog hammers contact material which cannot be readily broken upon impact. Because of possible machine damage, hog hammers do not normally protrude radially outwardly as far as free-swinging hammers. A large protrusion would also require much more power to force the hammer through the material. Typically, a hog hammer would protrude only about half as much as a free-swinging hammer. The resulting reduction in material contact area can push the material away from the hog hammer head rather than draw it into the disk assembly or drum, reducing the productivity and efficiency of the machine.

The related art does not disclose a waste processor which combines the attributes of a chipper, hammer mill and hog. However, one design has attempted to combine the attributes of a hog hammer with a hammer mill. This design provided for a limited swing of the free-swinging hammer. The design provided for the swinging hammer to protrude above the disk assembly the same distance as the typical free-swinging hammers, but the backward swing or recoil is restricted by a dead stop, wherein a portion of the hammer still protrudes radially outwardly from the disk assembly. At this point, further movement of the hammer is stopped and the swinging hammer has the attributes of a hog hammer.

This compromise arrangement enables the hammers to initially make good contact with the material being processed while using the large amount of kinetic energy stored in the disk assembly to do the work on the material. One disadvantage of this compromise arrangement is that the hammers receive two blows. The first blow occurs when the hammer impacts the material, but a damaging blow may occur when the hammer makes contact with the dead stop. A second disadvantage is that the hammer tip must be designed so that the hammer presents an impact face to the material in its laid back position that will not push the material away from the hammerhead. The required hammer profile for this arrangement rapidly changes shape as the hammer wears, resulting in a loss of performance.

SUMMARY OF THE INVENTION

The invention is directed to a waste processor for comminuting and chipping waste material. In the preferred embodiment, the waste processor comprises a generally cylindrical housing having an inlet opening on one side and an outlet opening on the other side. A choke plate is pivotally connected to the cylindrical housing and provides for altering the size of the outlet opening. A main shaft is axially mounted within the housing and is connected to a drive means, providing for the rotation of the main shaft within the housing. There are at least two disks mounted axially on the main shaft which rotate correspondingly with the shaft. A bearing shaft extends between the disks mounted on the main shaft. A swinging hammer is rotatably mounted to the bearing shaft between the two disks so that a portion of the swinging hammer extends radially beyond the periphery of the disks. The disks are adapted to mount a hog hammer and a chipper knife at the disks' periphery so a combination of swinging hammers, hog hammers and chipper knives can be used in a single waste processor to comminute and chip a variety of waste materials.

Preferably, each disk has a material guide at its outer periphery for directing the material in a predetermined direction. One of the disks located at the end of the disk assembly has a material guide which directs the material opposite the predetermined direction, deterring the accumulation of material at one end of the device.

The choke plate preferably comprises a lower plate, middle plate and upper plate which are connected by end plates. Each end plate pivotally mounts one end of a hydraulic cylinder and the cylindrical housing mounts the other end of the hydraulic cylinder. The hydraulic cylinder provides for pivoting the choke plate to alter the size of the outlet opening.

In one aspect, the waste processor has a stationary hammer mounted to the housing and which projects radially inwardly of the housing to a point near the periphery of the disks.

In another aspect, the waste processor has a tool support which mounts near the periphery of the disks.

Preferably, a stationary hammer is mounted to the housing in approximately the same plane as each disk and a stationary hammer is also mounted to the housing approximately midway between the plane of adjacent disks.

In yet another aspect, a hog hammer is mounted to the tool support and extends beyond the periphery of the disk.

In a further aspect, a knife assembly is mounted to the tool support and extends beyond the periphery of the disks. Preferably, the knife assembly has a knife holder which retains a knife blade so that the cutting edge of the knife blade extends slightly beyond the periphery of the disks.

Preferably, the disks have a disk aperture positioned radially inwardly from the periphery of the disks and aligned with each other. The swinging hammer has a shank with a base aperture which is positioned so as to align with the disk apertures when the swinging hammer is rotated radially inward, providing the fixing of the swinging hammer with respect to the disks by a single rod which passes through the disk apertures and the base aperture.

Preferably, the swinging hammer has a bearing surface which extends around the bearing shaft, and the coefficient friction between the bearing surface and the bearing shaft is not less than 0.20.

Preferably, the tool support is a block having a leading edge and a trailing edge. The trailing edge is disposed in the direction of rotation of the disks. The block has a mounting surface which extends between the leading edge and trailing edge. The mounting surface is coincident with an imaginary plane sloping from the leading edge to the trailing edge at an acute angle from an imaginary line intersecting the plane at a tangent point on the periphery of the disk.

Preferably, the tool support is radially spaced 45 degrees from the bearing shaft along the periphery of the disks.

Preferably, the block extends axially from the disk to abut an adjoining block on an adjacent disk, forming a single tool support which extends between adjacent disks. Parallel T-slots are disposed in the mounting surface of the block along lines extending from the leading edge toward the trailing edge of the block. The angle of the block is generally 35 degrees. The block mounts to the disk so that the block is recessed from the periphery of the disk.

Preferably, each block has opposed side edges which extend from the leading edge to the trailing edge, three T-slots intermediate the side edges, and a half T-slot at each side edge, so that when adjacent blocks are abutted, a whole T-slot will form at the side edges. The hog hammers can be mounted to the mounting surface of the block by tightening bolts and nuts located in the T-slots which provide for the hog hammer to slide down the mounting surface of the block if the hog hammer cannot break the waste material on impact. The knife assembly is also mounted to the mounting surface by tightening bolts and nuts in the T-slots. In another embodiment, three stationary hammers are disposed in substantially the same plane as at least one of the disks and the outlet opening is disposed between two of the stationary hammers.

Preferably, there are four swing hammers radially spaced 90 degrees apart along the periphery of the disks.

In another aspect, a waste processor which comminutes and chips waste material has a housing in which a main shaft is mounted. The main shaft is connected to a drive means, providing for rotating the main shaft within the housing. A disk is axially mounted to the main shaft and rotates with the main shaft. The disk mounts an improved tool support at the periphery of the disk. The improved tool support comprises a block having a leading edge and a trailing edge. The trailing edge is disposed in the direction of rotation of the disks. The block has a mounting surface which extends between the leading edge and trailing edge. The mounting surface is coincident with an imaginary plane sloping from the leading edge to the trailing edge at an acute angle from an imaginary line intersecting the plane at a tangent point on the periphery of the disk.

BRIEF DESCRIPTION OF THE DRAWINGS

The invention will now be described with reference to the drawings in which.

DETAILED DESCRIPTION OF THE PREFERRED EMBODIMENTS

Figure 1:
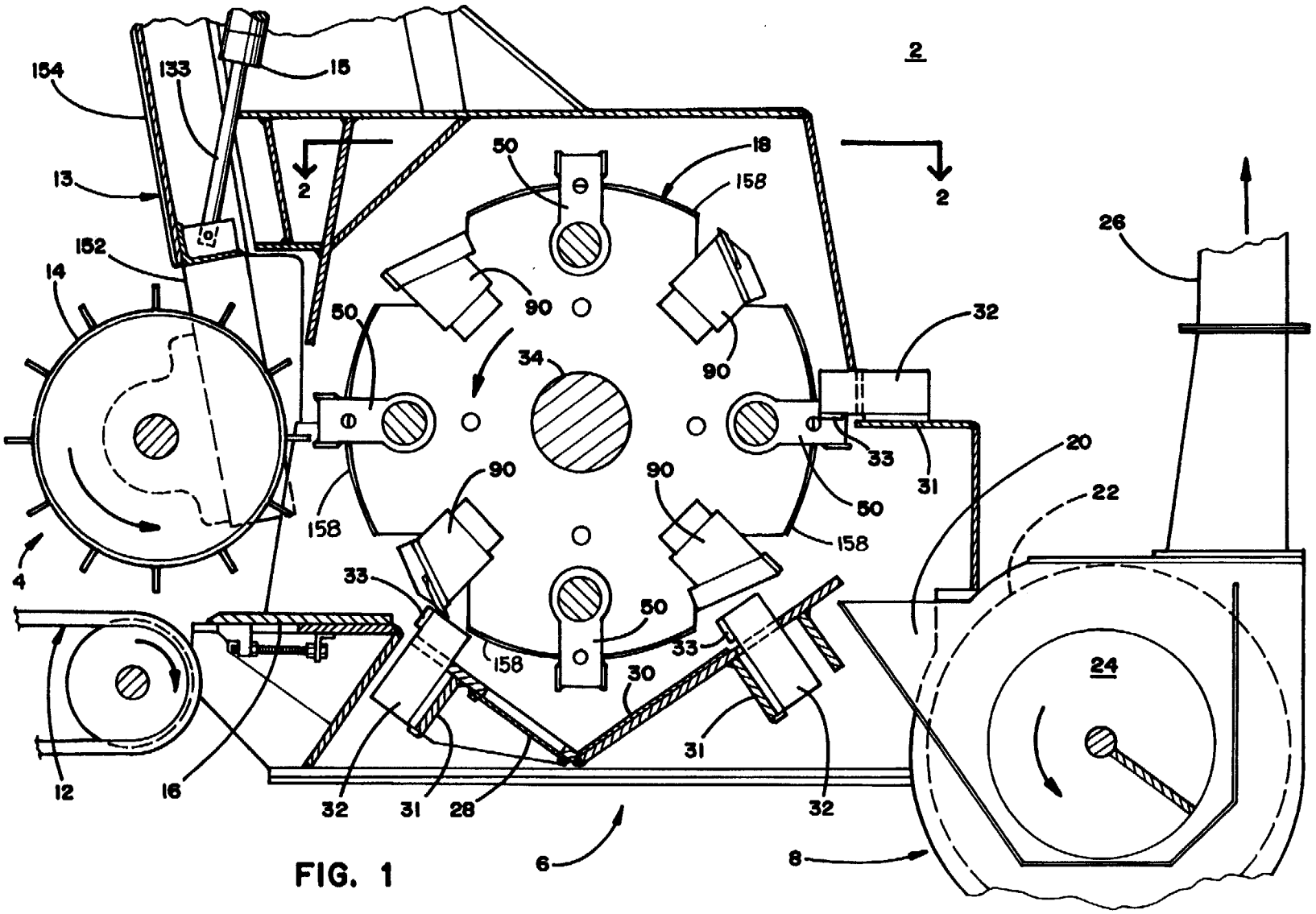
FIG. 1 is a side elevational view of the waste processor according to the invention.
Figure 2:
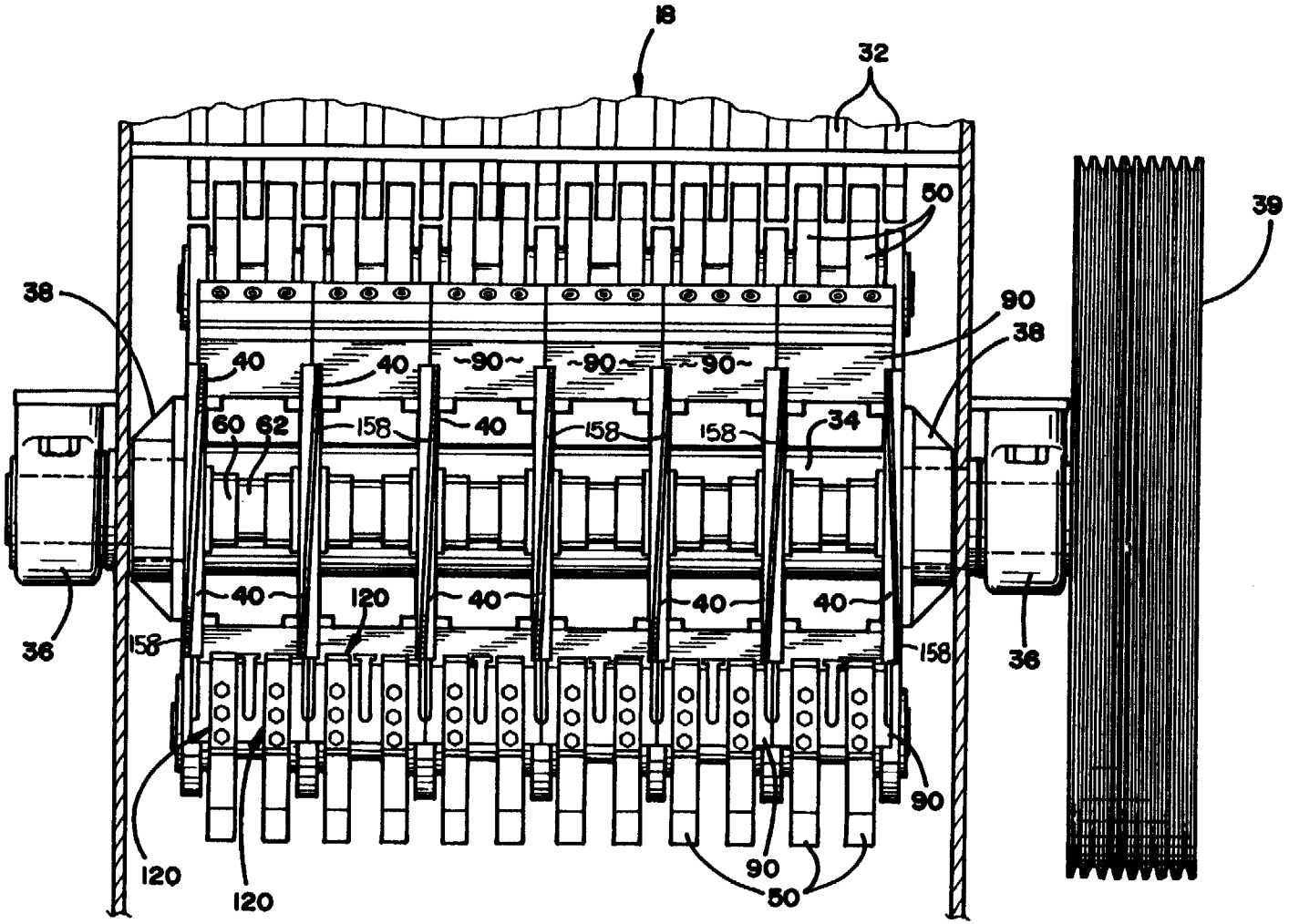
FIG. 2 is a top view of the waste processor along line 2—2 of FIG. 1.

Referring now to the drawings, FIG. 1 illustrates a first embodiment of a waste processing machine 2 which can combine the attributes of a chipper, hammer mill and hog, according to the invention, for comminuting and chipping waste material. The waste processing machine 2 comprises three major functional systems: the in-feed system 4, the mulching system 6 and mulch expelling system 8. Waste material enters the waste processing machine 2 through the in-feed system 4 where it is directed to the mulching system 6. The mulching system 6 breaks and chips the waste material into a mulch which is directed into the mulch expelling system 8. Preferably, the mulch expelling system 8 expels the mulch from the waste processing machine 2 by a screw conveyor or by an impeller.

The in-feed system 4 and mulch expelling system 8 are known. It is also known to use chippers, swing hammers and hog hammers separately to process waste material. The invention provides for uniquely combining the best attributes of the chippers, swing hammers and hog hammers to create a waste processing machine that can easily process any type of waste by varying the combination of chippers, swing hammers and hog hammers as needed.

Figure 11:
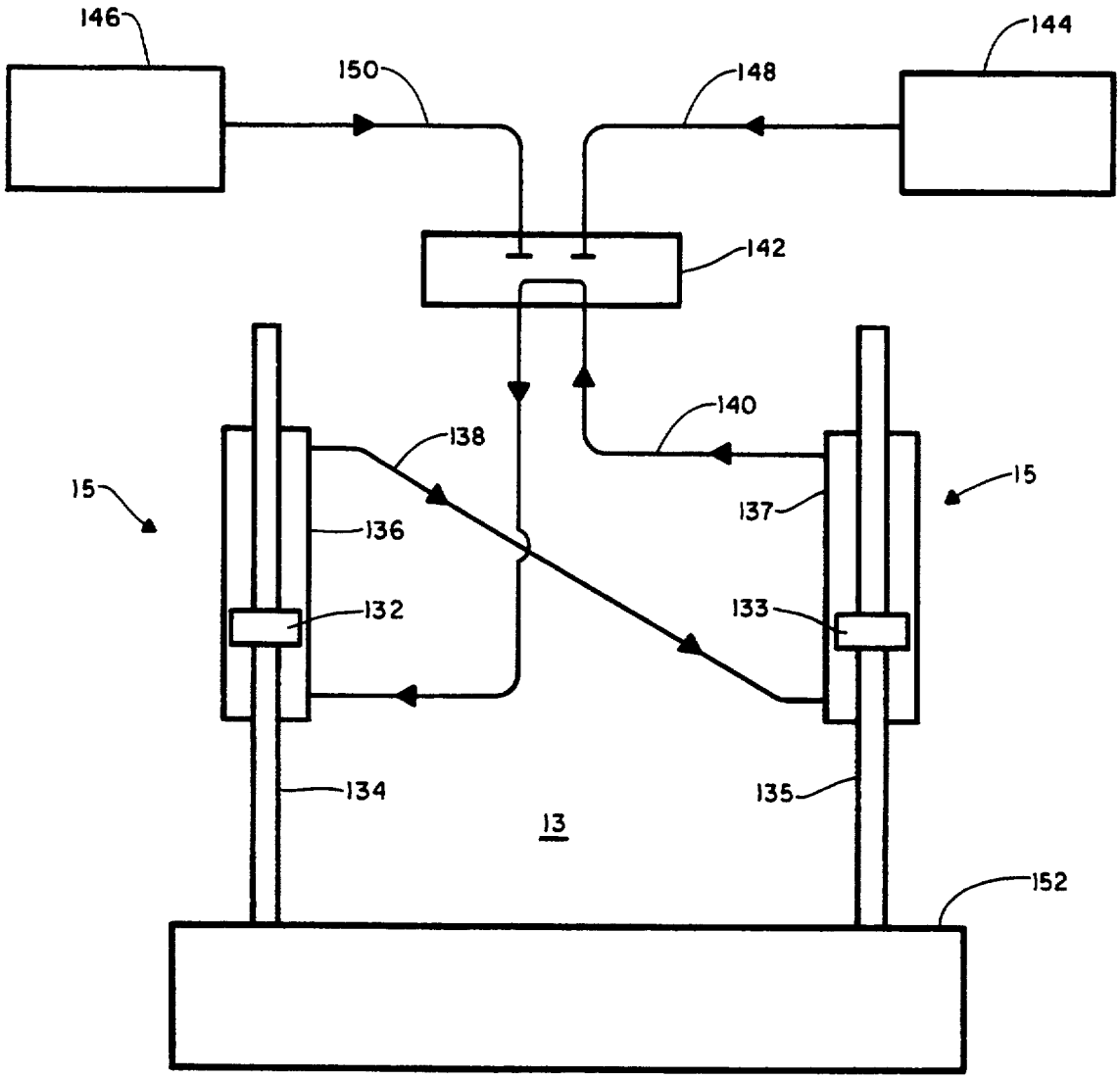
FIG. 11 is a schematic illustration of the hydraulic leveling system according to the invention.

The in-feed system 4 comprises in-feed conveyor 12, feed wheel slide system 13 and adjustable anvil 16. The feed wheel slide system 13 comprises feed wheel 14, hydraulic cylinders 15, slide box 152 and box frame 154 (FIG. 11). An inlet opening 17 is defined by the space between the feed wheel 14 and in-feed conveyor 12. The waste material is placed on the in-feed conveyor 12 which moves the material into contact with the feed wheel 14 which pushes the material through the inlet opening 17 and onto the adjustable anvil 16 which is adjacent to the mulching system 6. Material passing under the feed wheel 14 can cause the feed wheel slide system 13 to tilt resulting in possible binding of the feed wheel slide system 13. The hydraulic cylinders 15 are mounted to each end of the feed wheel slide system 13, providing for the automatic leveling of the feed wheel if it begins to bind as hereinafter described.

After the waste material is comminuted by the novel mulching system 6, the mulch is expelled from the waste processor 2. The mulch expelling system comprises discharge tube 20, impeller 22, screw conveyor 24, and thrower discharge 26. The discharge tube 20 is mounted at the lower rear of the disk assembly 18 and has a leading edge 21. The screw conveyor 24 is mounted to the bottom of the discharge tube 20. The impeller 22 is mounted at one end of the screw conveyor 24 and the thrower discharge is mounted above the impeller 22. The mulched material is passed from the disk assembly 18 through the discharge tube 20 to the screw conveyor 24 where the mulch is either moved out of the waste processing machine 2 by the screw conveyor 24 or passed on to the impeller 22 by the screw conveyor where it is blown out.

The novel mulching system 6 according to the invention is now described in greater detail. Referring to FIGS. I and 2, the mulching system 6 comprises disk assembly 18, maintenance covers 28, wear plate 30, and stationary hammers 32. The disk assembly 18 is covered by the housing 19 which preferably substantially conforms in shape to the disk assembly 18. The disk assembly 18 further comprises main shaft 34, pillow blocks 36, disks 40, swing hammers 50, swing hammer bearing 60, tool holder 90, chipper knife holder 100, and hog hammer 120. Main shaft bearings 38 are rigidly connected to the pillow blocks 36. The main shaft 34 passes through the main shaft bearings 38 and pillow blocks 36, and rides on the main shaft bearings 38. One end of the main shaft 34 passes through the associated pillow block 36 and is connected to a belt pulley 39. The belt pulley 39 is connected to a power source (not shown) and can accommodate single or multiple belts. Preferably, the belt pulley 39 accommodates multiple belts.

A plurality of disks 40 are mounted to the main shaft 34. The main shaft 34 passes through main shaft holes 42 of the disks 40. The number of disks 40 used is only limited by the available power to turn the main shaft 34 and width of the disks 40. However, it is preferable that seven disks 40 are mounted on the main shaft 34 with equal spacing between each disk. The disks 40 are preferably 42 inches in diameter. The preferred disk spacing is approximately 9 inches on center between adjacent disks 40.

The first embodiment, as illustrated in FIGS. 1 through 4, 6 and 7, further has material guides 158 which are disposed about the periphery of each disk 40. Each disk 40 further has an edge surface 188 which defines the outer periphery of the disks 40. The edge surface 188 is broken into sections 190 by the tool holder slots 44. Each edge surface section 190 is generally rectangular in shape with opposed ends 192 and 194. Preferably, the material guides 158 extend obliquely from one end to the other end of the edge surface 188. The material guides 158 are preferably made from ½-inch square key stock which is welded to the edge surface 188 of the disks 40. All of the material guides 58 are substantially parallel except for one of the material guides 158 on either of the end disks 40 of the disk assembly 18. The one material guide 158 which is not parallel to the other material guides 158 is placed obliquely across the opposite diagonal of the edge surface 188 of the disk 40 than the other material guides 158 to connect the opposite corners of the edge surface 188.

The material guides 158 impart a sideways motion to the oncoming material and direct the oncoming material to the swing hammers which are adjacent the disks 40. Most of the material guides 158 are substantially parallel to provide for the movement of the material in one direction. One of the material guides 158 is placed in the opposite direction to prevent the material from collecting at one edge of the disk assembly 18. For example, the majority of the material guides 158 shown in FIG. 13 direct the material from left to right as viewed with respect to the drawing. The material guide 158 on the right end disk 40 is opposite the other material guides 158 and directs the material from the right to the left which prevents the material from collecting at the right side of the disk assembly 18. By keeping the material moving laterally with respect to the disk assembly 18, the material guides 158 prevent the collection of the material directly in front of the edge surface 188 of the disk and between the disks 40, especially when the chipper knives 106 are not used.

In the first embodiment, there are three sets of stationary hammers 32. The three sets of longitudinally spaced stationary hammers 32 are positioned at the periphery of the disk assembly 18. The stationary hammers 32 are rigidly mounted to the stationary hammer mounting plates 31. Preferably, the stationary hammers 32 are mounted to the mounting plates 31 in groups of two or three to ensure proper spacing between the stationary hammers 32 and for ease of handling. The stationary hammers 32 are also mounted to the mounting plates 31 so that a stationary hammer 32 is in the same plane as each disk 40 and there is a stationary hammer 32 approximately at the midpoint between the centers of adjacent disks 40. In a waste processing machine 10 having seven disks 40, the corresponding number of stationary hammers is 13 per set or 39 total.

The first set of longitudinally spaced stationary hammers 32 is preferably located above the maintenance covers 28. The second set of stationary hammers 32 is preferably located adjacent to the wear plate 30. The third set of stationary hammers 32 is preferably located above the discharge tube 20. The hammer tip 33 of the stationary hammers 32 is disposed slightly away from the outer periphery of the disks 40, preventing the disks 40, chipper knife holder 100, and hog hammers 120 from contacting the stationary hammers as the disks 40 are rotated. The forward most set of stationary hammers 32 is lower than the adjustable anvil 16, providing for moving the adjustable anvil 16 over the stationary hammers 32 and in close proximity to the disks 40.

Figure 4:
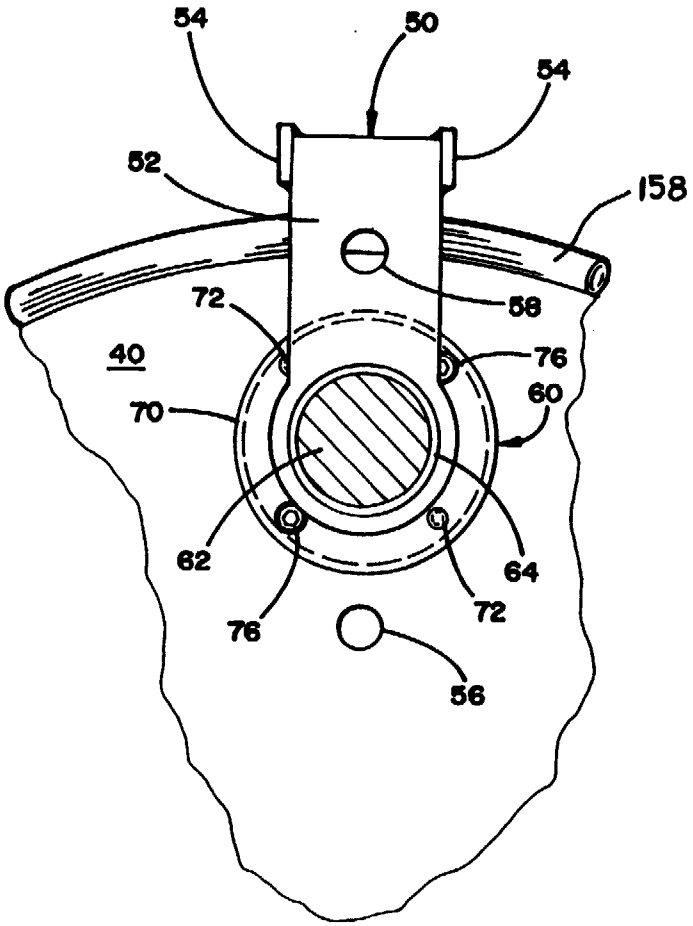
FIG. 4 is a partial side view of the waste processor shown in FIG. 3.
Figure 3:
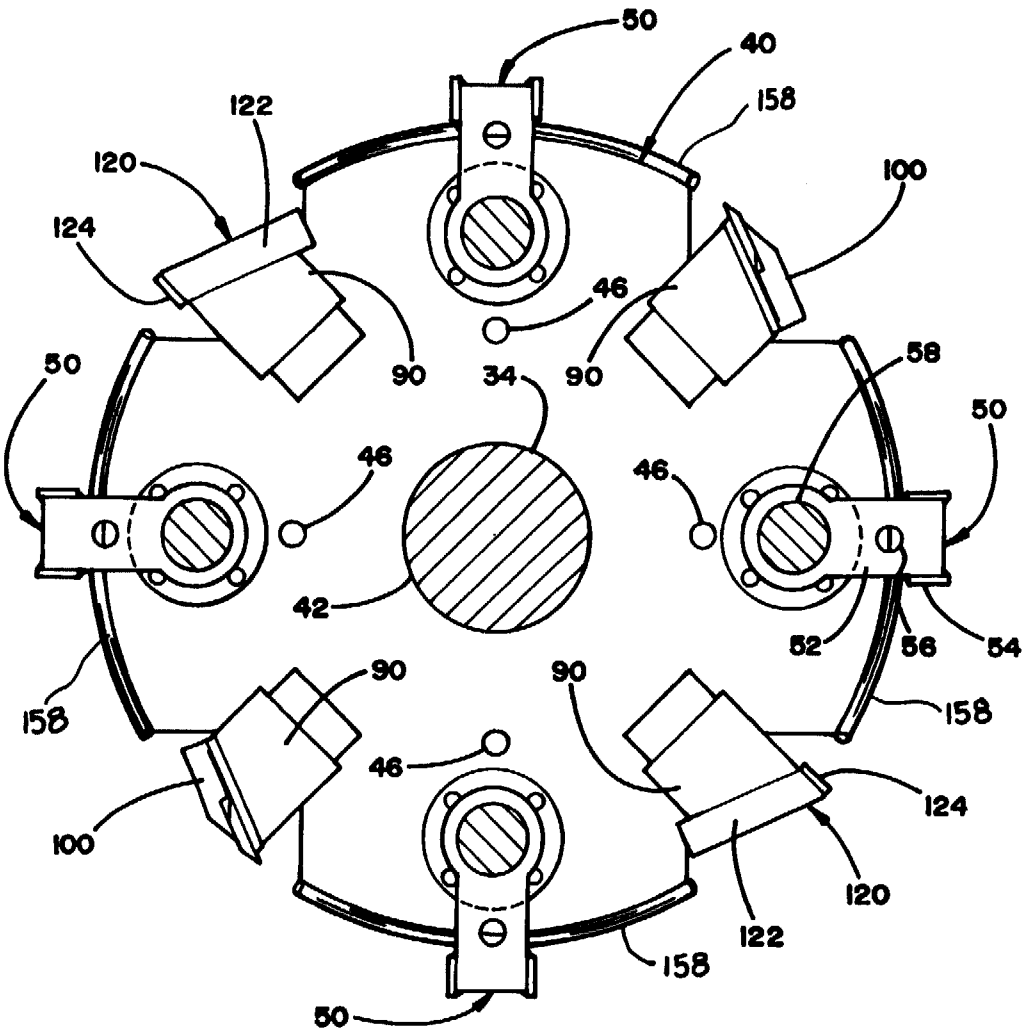
FIG. 3 is a side view of the waste processor along line 3—3 of FIG. 2.
Figure 5:
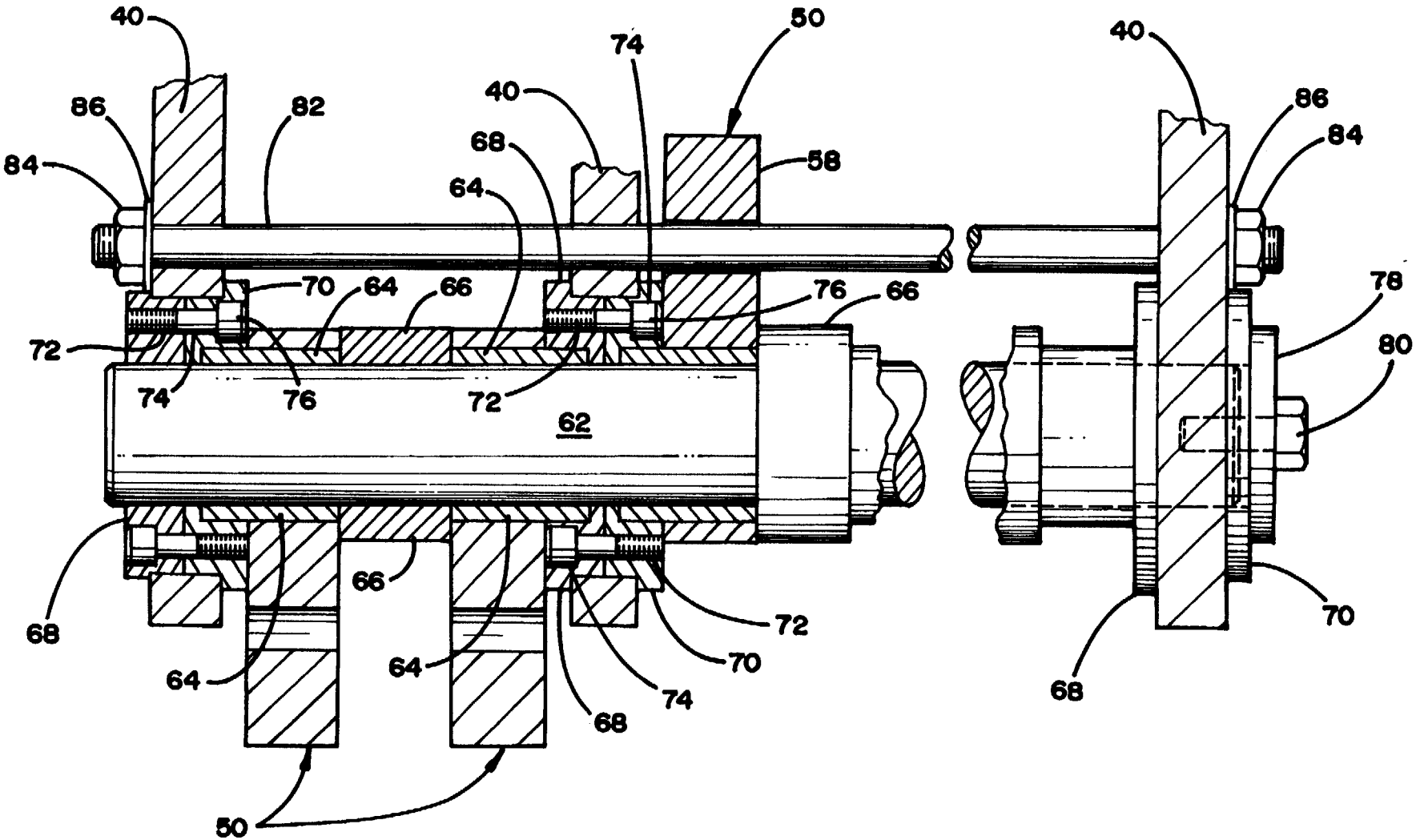
FIG. 5 is a partial sectional view of the waste processor along the line 5—5 in FIG. 2.

Referring to FIGS. 4 and 5, the swing hammer 50 comprises a shank 52 and hammers 54. The swing hammer bearing 60 comprises bearing shaft 62, sleeve bearings 64, spacers 66, outer mounting collars 68, inner mounting collars 70, and end plates 78.

The swing hammer bearing 60 is connected to each disk 40 by the outer mounting collar 68 and inner mounting collar 70. Both the inner mounting collar 70 and outer mounting collar 68 are inserted through a swing hammer bearing hole 48 on each disk 40, until flanges 69, 71 of the outer mounting collar 68 and inner mounting collar 70, respectively, contact the sides of each disk 40. A threaded bolt 76 is inserted into countersunk openings 74 and threaded into threaded openings 72 until tight, drawing the outer mounting collar 68 and inner mounting collar 70 into tight abutment with the disk 40.

The inner and outer mounting collars 68, 70 surround the sleeve bearings 64, retaining the sleeve bearings 64 in the desired position. The outer most disks 40 on each end of the main shaft 34 only have sleeve bearings 64 mounted on the inner surface of the outer most disks 40. All the other disks 40 have aligned sleeve bearings 64 on each side of each disk 40. The spacer 66 is placed between adjacent sleeve bearings 64. The spacers 66 are preferably located at approximately the center of the distance between adjacent disks 40. The outer mounting collar 68, inner mounting collar 70, sleeve bearing 64, and spacer 66 are all rotatably mounted to the bearing shaft 62. Both ends of the bearing shaft 62 are bolted to the outermost mounting collar 68 by end plates 78 and bolts 80.

The swing hammers 50 are rotatably mounted to the sleeve bearings 64. The sleeve bearing 64 passes through the bearing hole 58 of the swing hammer 50. The spacer 66 prevents the swing hammers 50 from moving longitudinally with respect to the bearing shaft 62, during the rotation of disks 40. The spacers 66 also keep the swing hammers 50 disposed between the stationary hammers 32 as the disk assembly 18 is rotated. Preferably, the swing hammers 50 and bearings 60 are positioned on the disk 40 so that the swing hammers will protrude approximately 3 inches beyond the circumference of the disks 40, advantageously providing the swing hammers with the ability to not only break up the waste, but to draw in and compress the waste towards the disk assembly 18 which aids chipper knives 106 in cutting.

The size of the swing hammer bearing 60 is preferably quite large compared to similar bearings on a typical hammer mill. It is known that hammer mills and especially the hammers themselves are high-wear items. The life of a swing hammer 50 varies widely, but for a hammer mill similar to the invention, the typical life is approximately 200 hours. The increased bearing diameter and width will increase the hammer life to approximately 1000 hours. Further, the larger bearing diameter provides for a greater friction torque to counteract the retrograde motion of the swing hammer after impact. If there was no friction in the swing hammer bearing 60, the swing hammer would continue to rotate in retrograde motion forever after impact, resulting in the swing hammer rotating away from any future blow.

The larger-diameter swing hammer bearing 60 produces a greater frictional torque because the friction force by a bearing is independent of the bearing area and the torque created by the friction of the bearing is equal to the friction force multiplied by the radius. The radius is measured from the axis of rotation of the bearing shaft 62 to the outer diameter of the sleeve bearing 64. The axis of rotation of the bearing shaft 62 is preferably located 16 inches radially outward from the axis of rotation of the main shaft 34. Therefore, as the diameter of the sleeve bearing 64 is increased, so is the radius, and for a constant frictional force the associated frictional torque is increased proportionally. Preferably, the outer diameter of the sleeve bearing 64 is 3-5/8 inches.

Preferably, the friction coefficient of the swing hammer bearing 60 is not less than 0.25 which provides for the swing hammer 50 to assume its original position within one revolution of the disk 40. The combination of the centrifugal force imparted to the swing hammer by the rotating disk 40 and the friction torque of the swing hammer bearing 60 retards the retrograde motion of the swing hammer after impact. With a friction coefficient not lower than 0.25, the swing hammer should stop spinning in a retrograde motion during the first 180 degrees after impact. The centrifugal force imparted to the swing hammer 50 by the disk assembly 18 will then accelerate the hammer in the opposite direction so that the swing hammer 50 reaches its original position in time for the next blow. At this moment, the hammer 50 has a rapid forward motion. The hammer tip speed is almost twice the nominal tip speed relative to the rotating disk assembly.

Still referring to FIG. 5, if it is desired not to use the swing hammers during the processing of the waste, the swing hammers 50 can lock to the disk 40 so that the swing hammers 50 do not protrude beyond the circumference of the disk 40. To lock the swing hammers 50 to the disks 40, the swing hammers 50 are rotated until locking holes 56 of the swing hammers 50 align with swing hammer locking holes 46 of the disks 40. A locking bar 82 is then inserted through the aligned swing hammer locking holes 46 of the disks 40 and the locking holes 56 of the swing hammers 50. The ends of the locking bar 82 are secured in place by nuts 84 which thread onto the ends of the locking bar 82, contacting the washers 86 which tighten against the outermost disks 40. In the locked position, the swing hammers 50 will not interfere with the operation of the waste processing machine 10.

Figure 8:
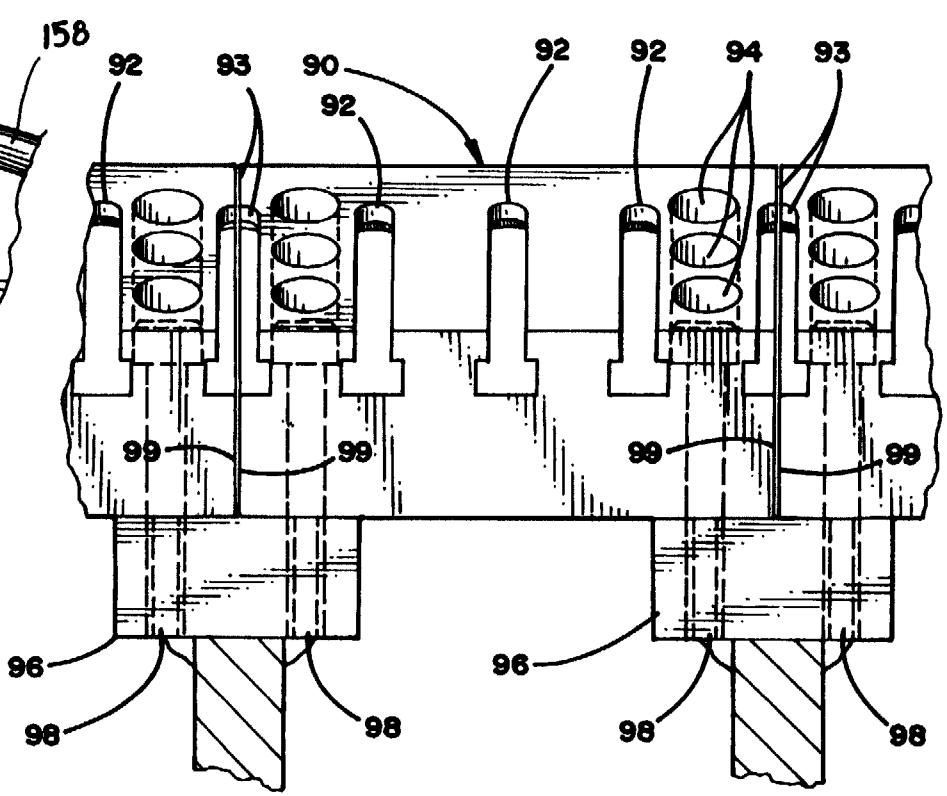
FIG. 8 is a partial sectional view of the waste processor along the line 8—8 in FIG. 7.
Figure 6:
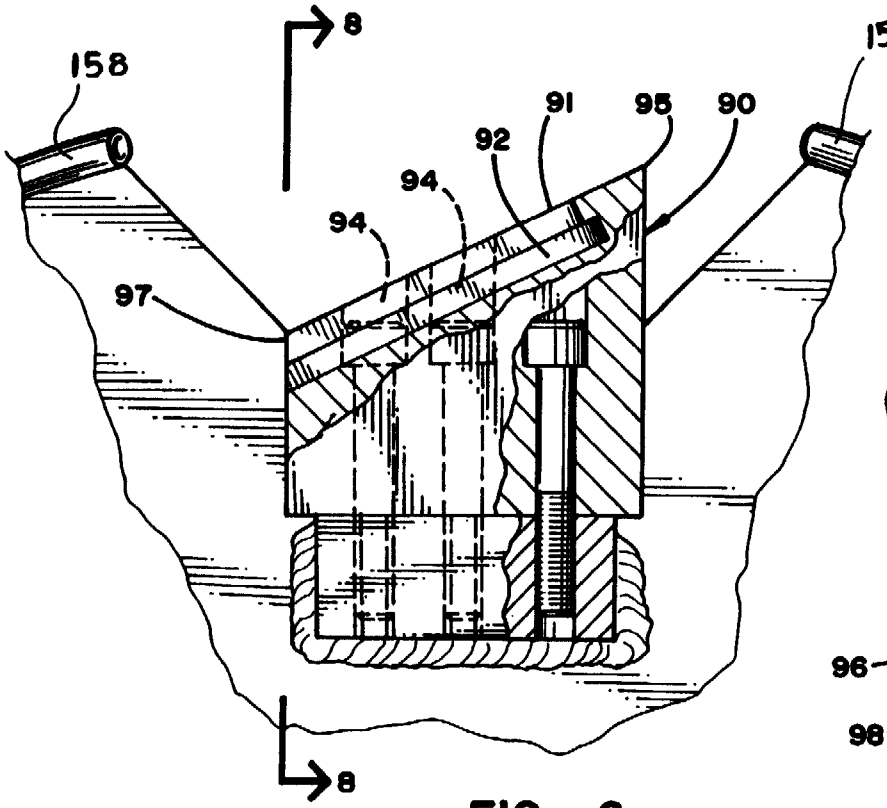
FIG. 6 is a partial sectional view of the waste processor along line 6—6 of FIG. 2.
Figure 7:
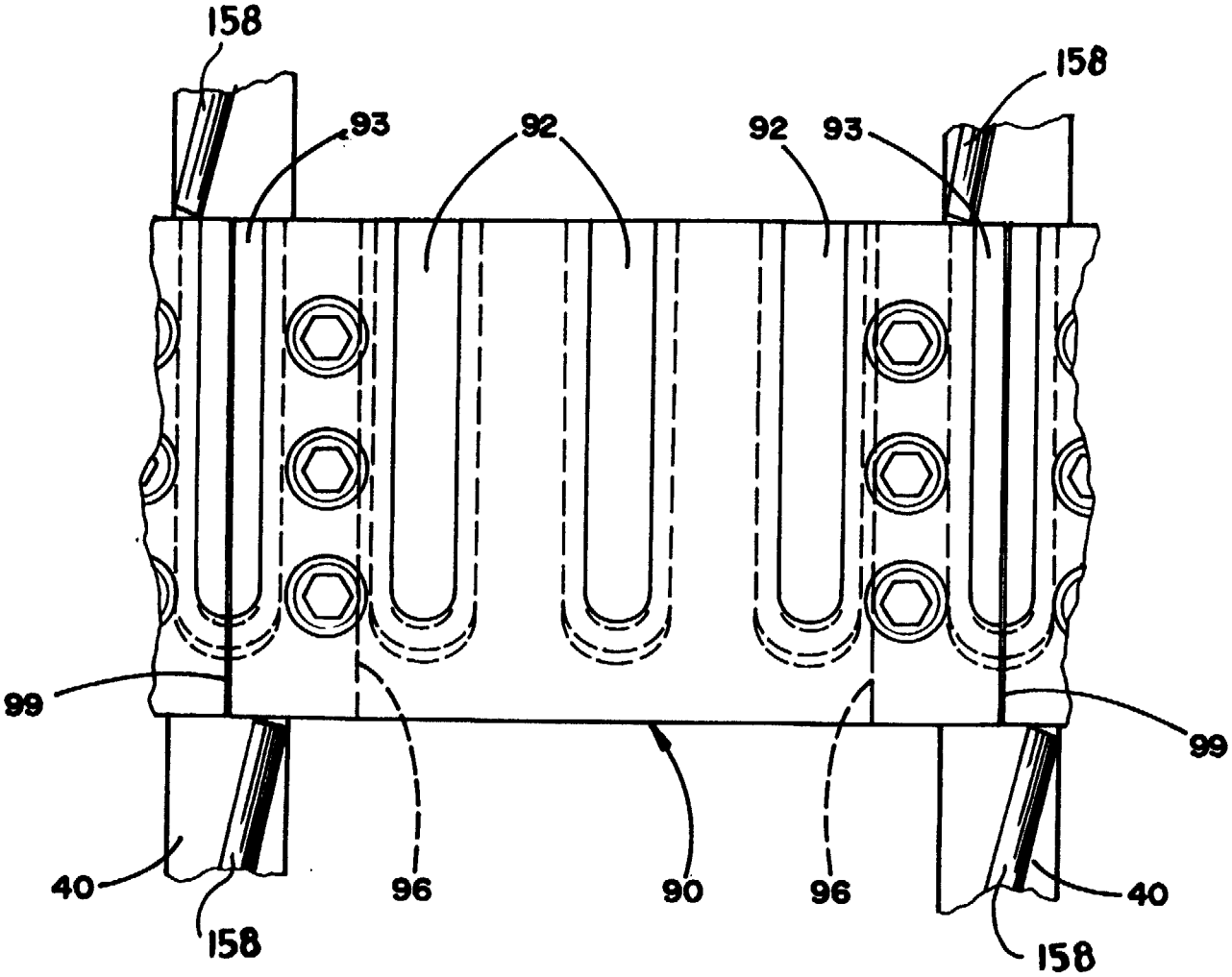
FIG. 7 is a partial sectional view of the waste processor along line 7—7 of FIG. 2.

Referring now to FIGS. 6 through 8, the tool holder 90 has mounting surface 91, T-slots 92, and mounting holes 94. The tool holder mounting block 96 has mounting holes 98. Each side of the tool holder 90 is mounted to a disk 40. Each disk 40 has a tool holder mounting block 96 welded to the lower most portion of the tool holder slots 44. The bottom of the tool holder 90 rests on the upper surface of the adjacent tool holder mounting blocks 96. The mounting holes 94 of the tool holder 90 align with the holes 98 of the tool holder mounting block 96. Bolts 99 are inserted through the mounting holes 94 of the tool holder 90 and are threaded into the threaded holes 98 of the tool holder mounting blocks 96, securing the tool holders 90 to the tool holder mounting blocks 96. The ends of the tool holder 90 lie on the center line of the associated disk 40, providing for the tool holders 90 to mount to adjacent disks 40 and span across the width of disk assembly 18.

The mounting surface 91 of the tool holder 90 has leading edge 95 and trailing edge 97. The perimeter of the mounting surface is defined by the leading edge 95, trailing edge 97 and ends 99. Preferably the mounting surface 91 forms approximately a 35-degree angle with respect to a line that is tangent to the disk 40 at the point on the disk 40 directly below the tip of the knife 106 or hog hammer tip 124, whichever tool is mounted to the tool holder 90. The tool holders 90 have half T-slots 93 at there ends which form a complete T-slot 92 when the tool holders are mounted adjacent to each other, providing for the mounting of chipper knife holder 100 or hog hammers 120 across adjacent tool holders 90.

Figure 9:
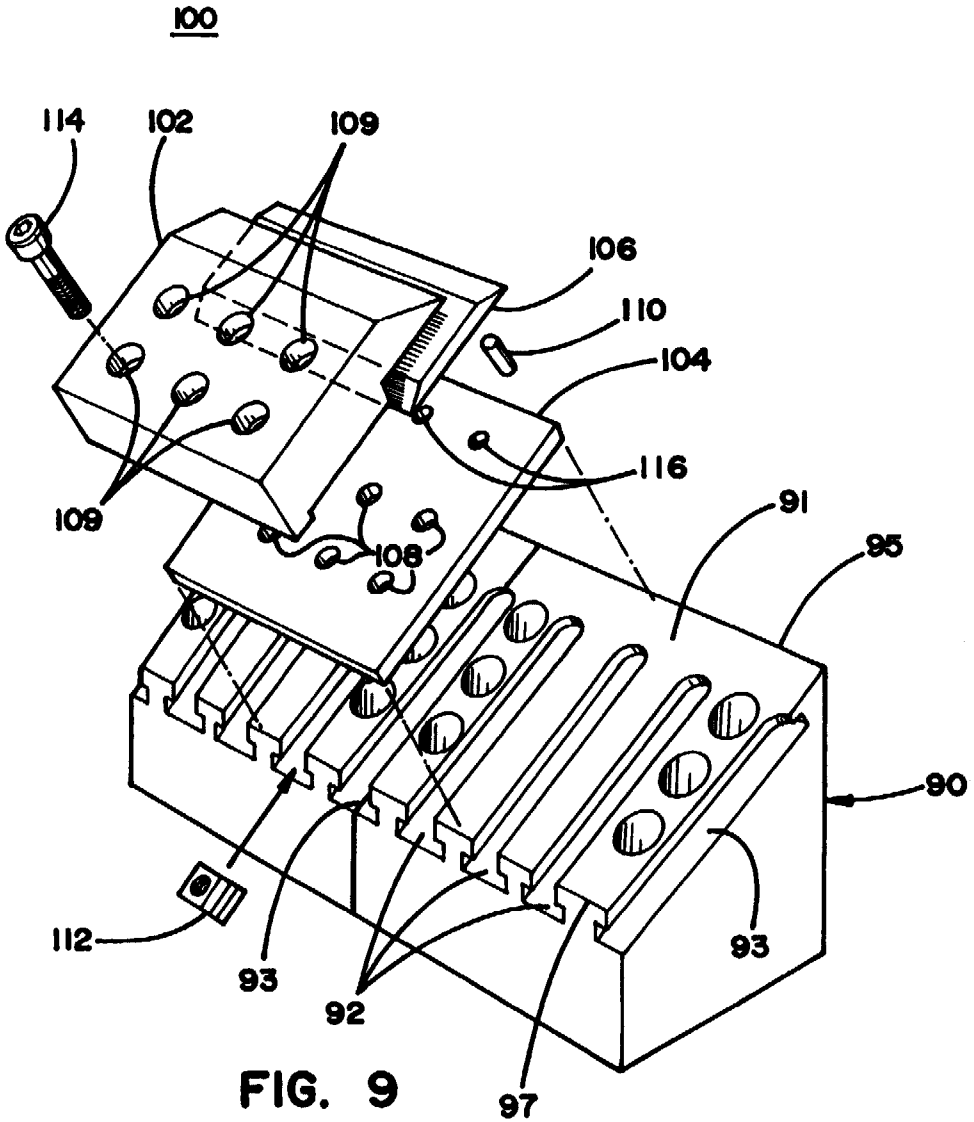
FIG. 9 is an exploded view of the chipper blade and tool holder according to the invention.

Referring to FIG. 9, the chipper knife holder 100 mounts to the tool holder 90. The chipper knife holder 100 comprises clamp 102, counter knife 104, and knife 106. The counter knife 104 has holes 108. The clamp 102 has countersunk holes 109. T-nuts 112 slide in the T-slots 92 of the tool holder 90. The knife 106 and counter knife 104 have corresponding knife holes 116 and 118.

The chipper knife holder 100 is mounted to the tool holder 90 by T-nuts 112 which are slidably mounted in the T-slots 92 of the tool holder 90. The T-nuts 112 receive the socket head cap screws 114 through the holes 108 of the counter knife 104 and the countersunk holes 109 of the clamp 102. The socket head cap screws 114 are then threaded into the T-nuts 112 and tightened to secure the chipper knife holder 100 to the tool holder 90. The knife 106 is secured to the counter knife 104 by a set screw 110 threaded into the corresponding knife holes 116 and 118. The knife 106 protrudes slightly beyond the circumference of the disk 40, preferably ½ inch. The chipper knife holder 100 can mount many other types of knives. It is known to use a knife having slots instead of knife holes 116, providing for radially adjusting the knife with respect to the disks 40.

The preferred knife width is any width shorter than the distance between the outer most disks 40 of the disk assembly 18. Preferably, the knives 106 are not as wide as the tool holders 90. The knives 106 are preferably mounted to the tool holders with gaps between successive knives 106. Therefore, it is preferred to have at least two rows of knives 106, and the different rows of knives 106 are offset to eliminate any gaps during contact of the knives 106 on the waste material. However, it is possible to mount the knives 106 across the disk assembly without having any gaps between adjacent knives.

Figure 10:
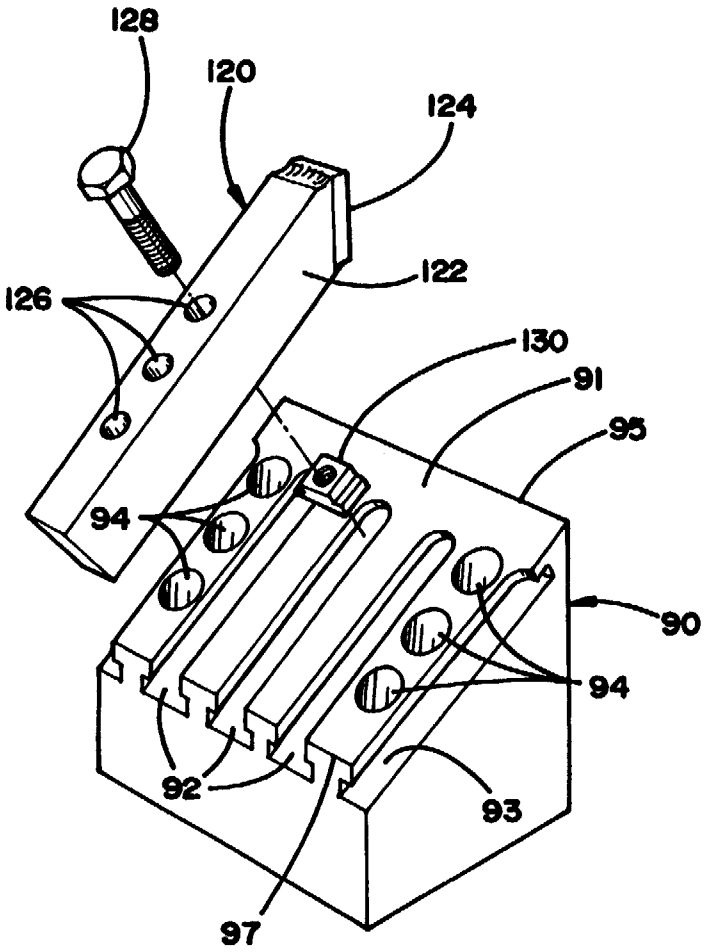
FIG. 10 is an exploded view of the hog hammer and tool holder according to the invention.

Referring to FIG. 10, the hog hammer 120 mounts to the tool holder 90. The hog hammer 120 comprises body 122 and hammer tip 124. The body 122 has mounting holes 126. The hog hammer 120 can mount to the tool holder in a manner similar to the chipper knife holder 100 by T-nuts and socket head cap screws. However, FIG. 10 shows an alternate mounting using T-bolts 128 slidably mounted in T-slots 92 and projecting through the aligned mounting holes 94, 126 of the tool holder 90 and hog hammer 120 with nuts 130 threaded onto the ends of the T-bolts 128. The chipper knife holder 100 can also mount using the T-bolts and nuts. The hog hammers 120 are preferably mounted in the T-slots 92 which are not aligned with the disk 40 so as not to impede the rearward movement of the hog hammer 120 when it encounters an unbreakable object.

Figure 12:
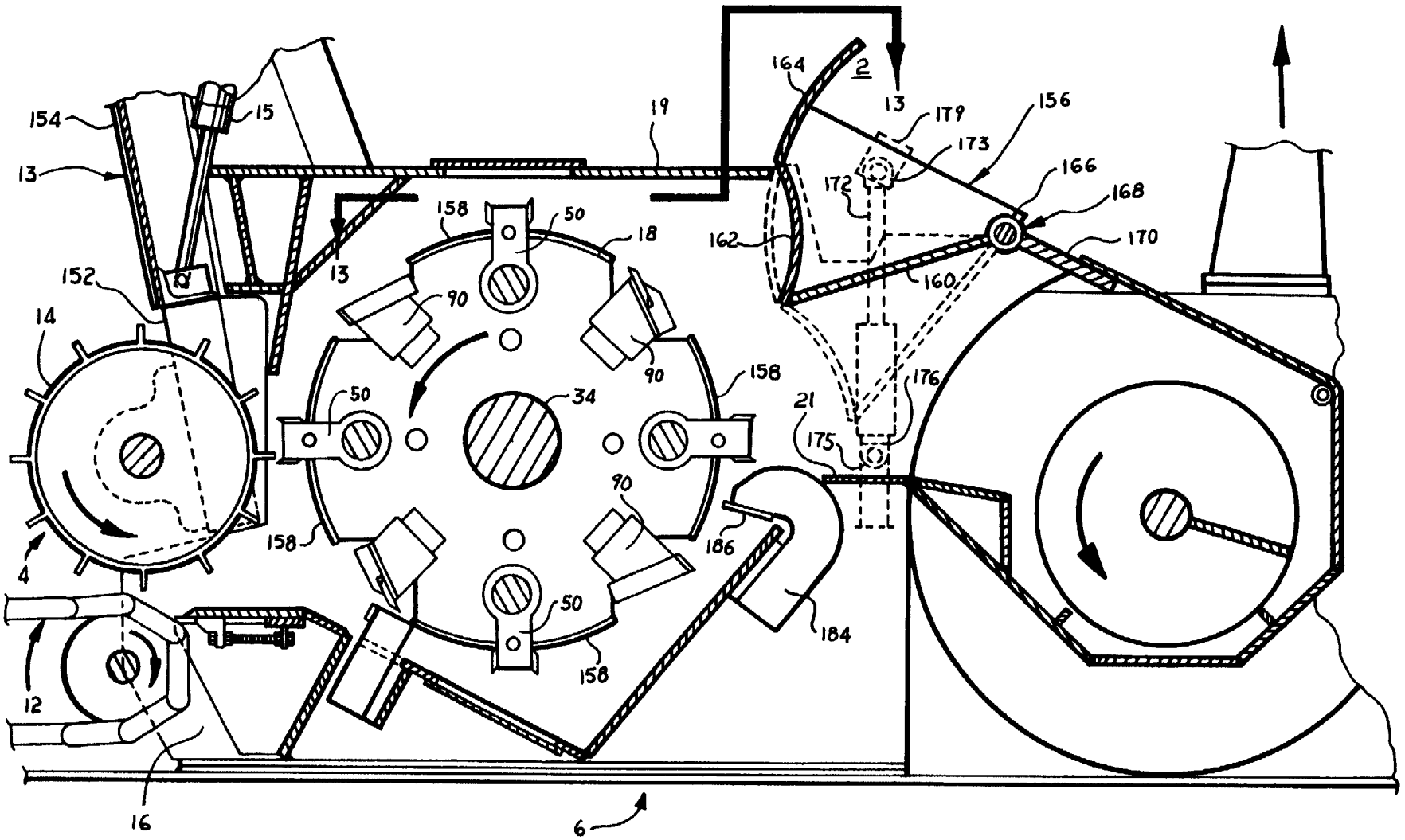
FIG. 12 is a side elevational view of a second embodiment of the waste processor according to the invention.
Figure 13:
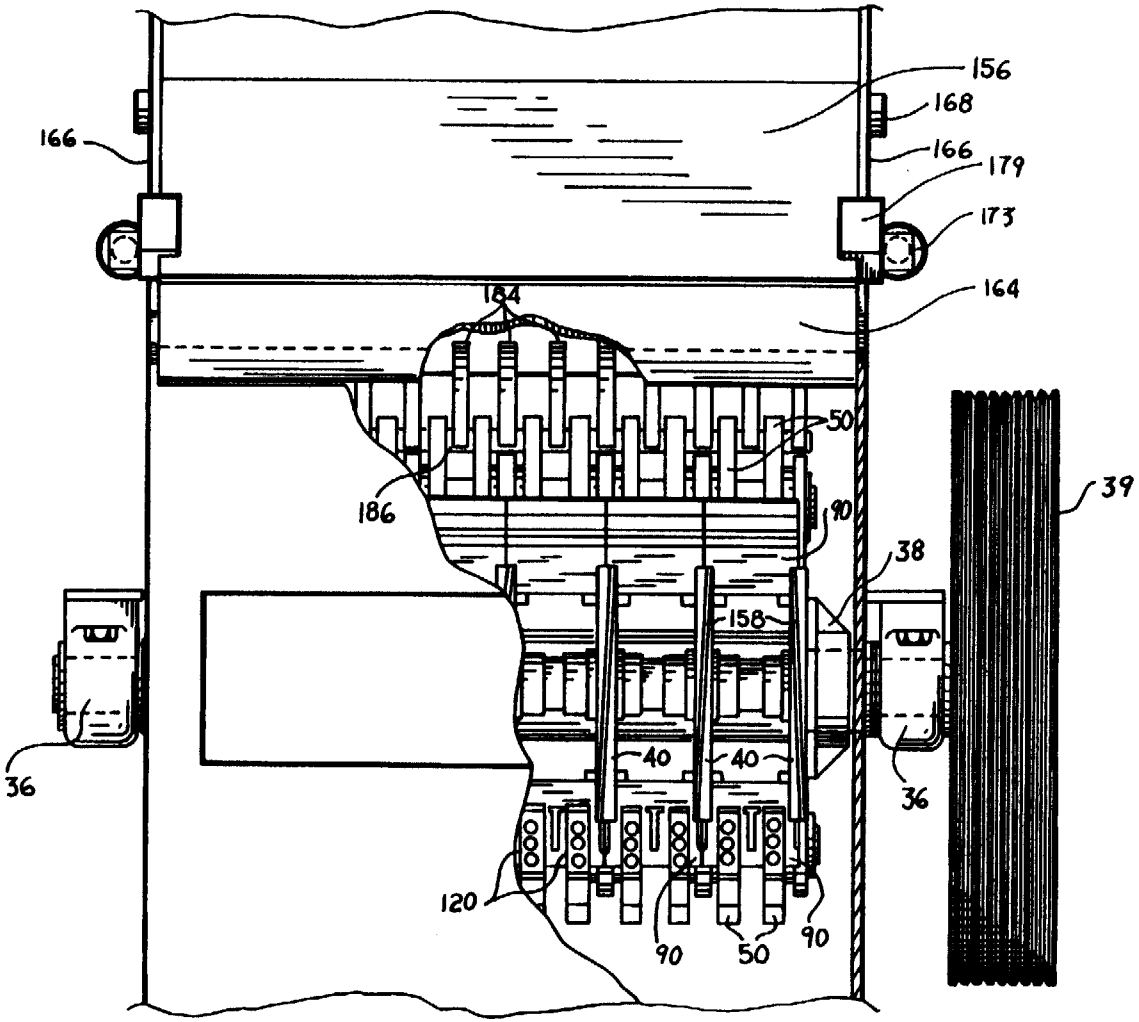
FIG. 13 is a top view of the second embodiment of the waste processor along line 13—13 of FIG. 12.

A second embodiment of the waste processing machine 2 is illustrated in FIGS. 12 and 13. The second embodiment is similar to the first embodiment with the principal differences being that only two rows of stationary hammers are provided and that a movable choke plate 156 is disposed above the discharge tube 20 of the mulch expelling system 8.

The choke plate 156 and the leading edge 21 of the discharge tube 20 define a discharge tube opening 159. Movement of the choke plate 156 as described hereinafter alters the size of the discharge tube opening 159. It has been found that the size of the particles produced by the waste processing machine 2 can thus be adjusted. As the size of the discharge tube opening 159 is decreased, less material is able to exit through the discharge tube 20 and the material which does not exit is carried by centrifugal force around the disk assembly 18 where the mulch particles are acted on again by the predetermined combination of chippers 100, hog hammers 120 and swing hammers 50 to further reduce the size of the particles.

The choke plate 156 comprises lower plate 160, middle plate 162 and upper plate 164 which are connected by opposed end plates 166. Preferably, the lower plate 160, middle plate 162, upper plate 164 and end plate 166 are welded together. The choke plate 156 is pivotally connected by hinge 168 to the hinge plate 170 of the waste processing machine 2. The hinge 168 is preferably positioned to provide for the choke plate 156 to be disposed substantially above the discharge tube 20 of the mulch expelling system 8. However, the choke plate 156 could be placed anywhere desired to limit the size of the discharge tube opening providing the choke plate does not interfere with the disk assembly 18.

Hydraulic cylinders 172 provide for pivoting the choke plate 156 about the hinge 168. Each hydraulic cylinder 172 has opposed ends 173, 175. The hydraulic cylinders 172 are mounted on opposite ends of the choke plate 156 by pivotally mounting one opposed end 173 of the hydraulic cylinder 172 to the end plate 166 with mounting bracket 174 and pivotally mounting the other opposed end 175 of the hydraulic cylinder 172 to the waste processing machine 2 with mounting bracket 176.

The middle plate 162 and upper plate 164 are arcuate in cross section. The arcuate cross section of the middle plate 162 preferably has the same radius of curvature of the disks 40. The middle plate provides for continuing the general shape of the housing 19 to direct the particles about the disks 40 during operation of the waste processing machine 2, and to prevent the particles which do not enter the discharge tube 20 from collecting against the choke plate 156. The arcuate cross section of the upper plate 164 provides for the sealing of the housing 19 of the waste processing machine 2, preventing the inadvertent expulsion of particles.

The size of the discharge tube opening 159 can be altered by energizing the hydraulic cylinder 172 to move the choke plate 156. As the size of the particle exit opening 182 is reduced, fewer particles are able to exit into the discharge tube 20 and more particles are forced by the centrifugal force around the disk assembly 18 where they must pass at least one more time through the combination of swing hammers 50, chippers 100 and hog hammers 120 which further reduce the size of the particles before they can exit the waste processing machine 2 through the discharge tube opening 159. Therefore, it is possible to control the size of the particles exiting the waste processor 2 by controlling the size of the discharge tube opening 159. Advantageously, the size of the discharge tube opening 159 can be changed during the operation of the waste processor machine 2, obviating the necessity of turning off the machine to alter the discharge tube opening 159.

In the second embodiment, when the choke plate 156 is added to the waste processor 2, it is preferred that the third set of stationary hammers 32 and their mounting plate 31 which are disposed above the discharge tube 20 are removed to provide the choke plate 156 with the greatest possible range of movement about the hinge 168. Further, it is preferable that the second set of stationary hammers 32 be replaced by alternate stationary hammers 184. The alternate stationary hammer 184 is similar to the stationary hammer 32 in that it is positioned substantially identically to the original stationary hammer 32 and it has a corresponding hammer tip 188 which is similar to the hammer tip 33 of the original stationary hammer 32. The second embodiment can also have the material guides 156 as disclosed in the first embodiment.

In operation, the material, such as wooden pallets, is placed on the in-feed conveyor 12. The material rides on the in-feed conveyor 12 until it is disposed below the feed wheel 14 which pushes the material along with the in-feed conveyor onto the adjustable anvil 16, bringing the material within reach of the disk assembly 18. The feed wheel slide system 13 by its weight partially crushes and compacts the waste material before it reaches the disk assembly 18. The vertical position of the feed wheel 14 is automatically adjusted when necessary to prevent binding of the feed wheel slide system 13 by the hydraulic cylinders 15. Each hydraulic cylinder 15 comprises a piston 132, 133 mounted to a rod 134, 135 which move internally to a cylinder 136, 137. The ends of the rods 134 are mounted to the slide box 15 which mounts the feed wheel 14 and slides within the box frame 154. The cylinders 15 are mounted to the box frame 154 of the waste processing machine 10. A hydraulic line 138 connects the top of cylinder 136 to the bottom of cylinder 137. Hydraulic line 140 connects the top of cylinder 137 to the bottom of cylinder 136 after passing through a direction control valve 142. A hydraulic pump 144 and hydraulic fluid reservoir 146 are connected to the direction control valve 142 by hydraulic lines 148, 150, respectively.

When material passes between the conveyor 12 and feed wheel, the feed wheel will automatically ride up over the material. Because of the length of the feed wheel, if the load is offset from the center, the slide mechanism may tend to bind.

When the lifting force imparted by the material on the feed wheel 14 causes the rod 134 to lift, the fluid in the top of the cylinder is forced down hydraulic line 138, into the bottom of the cylinder 137 by piston 132 and exerts a lifting force on the bottom of the piston 133 in cylinder 137. The fluid in the top of cylinder 137 then passes through hydraulic line 140, to fill the void at the bottom of cylinder 136, equalizing the fluid in both cylinders. Both pistons move up and down in equal distances, causing the feed wheel 14 to remain level. If a lifting force is encountered at the opposite end, the oil moves along hydraulic lines 138 and 140 in the opposite direction, producing the same result.

The feed wheel 14 can be lifted with or without an incoming load by passing through the control valve 142 from the hydraulic pump 144, fluid exerting a force on the bottom of piston 132 producing a lifting action, producing an equal lifting force at the bottom of piston 133. The fluid from the top of the piston 133 flows through the control valve 142 back to the hydraulic reservoir 146. Similarly, a downward pressure can also be put on the top of cylinder 137 to force the slide box down.

After the material is passed through the feed wheel 14, the material is contacted by whatever tool combination of swing hammers 50, chipper knives 106 and hog hammers 120 is mounted to the disk assembly 18, breaking or chipping the material into a mulch. By simultaneously using all three tools or a combination of the three tools, a very efficient waste processor is obtained. Assuming all three tools are mounted to the disk assembly 18, the swing hammers 50 contact the waste first, further crushing and compacting the waste while drawing the waste closer to the disk assembly 18. The hog hammers 120 will contact the waste second and further crush and compact the waste. The chipper knives will then chip the compacted material into even finer pieces. It is beneficial that the swing hammers 50 and hog hammers 120 crush and compact the material because the knives 106 of the chipper knife holder 100 cut compacted material more efficiently than loose, springy material.

The material guides 158 will direct the incoming material laterally to ensure the material is contacted by the swing hammers 50, chippers 100 or hog hammers 120 and that the material does not collect at the edge surface 188 of the disks 40 or between the disks 40. The one material guide 158 which is opposite the other material guides 158 will prevent the material from collecting at one end of the disk assembly 18.

The centrifugal force imparted by the chipper knife holders 100, swing hammers 50 or hog hammers 120 to the mulch will force the material into the discharge tube 20. The processed material is then removed from the discharge tube by the screw conveyor 24 which removes the process material to an awaiting container or to the impeller 22 which throws the process material out the thrower discharge 26. If desired, the impeller 22 and thrower discharge 26 can be replaced with a disk type chipper which could reduce the output from the recycler to smaller chips.

In the second embodiment, the position of the choke plate 156 can be altered while operating the waste processor 2 to alter the size of the discharge tube opening 159, providing for the operator to control the particle size entering the discharge tube 20. The operator actuates the hydraulic cylinders 172 to reduce the discharge tube opening 159 until the desired particle size is expelled from the waste processor 2.

The tool selection is controlled by the type of waste being processed. If the material being processed is "clean" (having no metal or rocks), then only knives 106 are mounted to the tool holders 90. If the material being processed is slightly "dirty," (having some rock and dirt fragments), the preferred combination includes only swing hammers 50 and chipper knives 106. The swinging hammers also clean sand and rocks from wood waste (such as tree stumps) before they reach the chipper knives 106 which greatly increases the capacity to use chipper knives 106, which in turn will increase the productivity of the waste processing machine 10. It is possible and sometimes desireable to use a combination of swing hammers 50, chipper knives 106 and hog hammers 120. If the chipper knives 106 and hog hammers 120 are used simultaneously, it is preferred that the chipper knives 106 and hog hammers 120 are alternately mounted to the tool holders 90. If the material being processed contains metal, the chipper knives 106 are generally not used and only hog hammers 120 are mounted to the tool holders 90. A combination of swing hammers and hog hammers is generally used for "dirty" material containing metal.

The swing hammers 50 are positioned on the disks 40 so that they move between the stationary hammers. The swing hammers 50 and the stationary hammers 32 will usually break any material caught between them into smaller pieces, unless the material is too large to break. The stationary hammers 32 provide a surface for trapping material so that the hammer 54 of the swing hammer 50 contacts the material approximately perpendicular to the surface of the material, rather than a glancing blow.

If the hog hammer 120 is used, the body 122 of the hog hammer 120 will contact the material imparting the centrifugal force of the disk assembly 18 to the material, causing the material to break into smaller pieces. If the hog hammer 120 contacts material which cannot be broken, the resulting impact will force the hog hammer to slide down the mounting surface 91 of the tool holder 90. The hog hammer 120 can slide down the mounting surface 91 until it is disposed equal to or behind the circumference of the disk 40, preventing further damage to the hog hammer and disk assembly. The waste processing machine 10 will then be turned off and the unbreakable material will be removed. The hog hammer 120 is then manually returned to its original position and the waste processing machine 10 can be restarted.

Reasonable variation and modification are possible within the spirit of the foregoing specification and drawings without departing from the scope of the invention.

The embodiments for which an exclusive property or privilege is claimed are claimed as follows:

1. In an apparatus for comminuting and chipping waste material comprising a substantially enclosed housing having an inlet opening on one side thereof and an outlet opening on another side thereof, wherein waste material is introduced into the housing through the inlet opening and expelled from the outlet opening, a shaft mounted axially within the housing, said shaft being connected to drive means for rotating the shaft within the housing, a tool spaced radially from the shaft and mounted to the shaft for rotation therewith, said tool comprising a disc mounted to the shaft and being adapted to comminute and chip waste material introduced into the housing, the improvement comprising:

a material guide comprising a rib mounted on the edge of the disc for directing the waste material axially within the housing in a predetermined direction, the material guide being spaced radially from the shaft a distance less than or equal to the distance the tool is spaced radially from the shaft.

2. An apparatus for comminuting and chipping waste material according to claim 1 further comprising a choke plate movably mounted to the housing in a position to selectively cover the outlet opening.

3. An apparatus for comminuting and chipping waste material according to claim 1 wherein the housing is generally cylindrical, the inlet and outlet openings are disposed radially from the shaft and the choke plate is mounted pivotally relative to the housing.

4. An apparatus for comminuting and chipping waste material according to claim 3 wherein the choke plate further comprises a lower plate, middle plate, upper plate and end plates with the middle plate having an arcuate cross section for directing the waste material around the interior of the housing.

5. An apparatus for comminuting and chipping waste material according to claim 4 wherein the middle plate of the choke plate has substantially the same radius of curvature as the substantially cylindrical tool.

6. An apparatus for comminuting and chipping waste material according to claim 4 further comprising hydraulic cylinders, each having opposed ends with one end pivotally mounted to an end plate and the other end pivotally mounted to the housing for pivoting the choke plate to alter the outlet opening.

7. An apparatus for comminuting and chipping waste material according to claim 1 wherein the housing is substantially cylindrical and the inlet and outlet openings are in the cylindrical housing.

8. An apparatus for comminuting and chipping waste material according to claim 7 wherein the choke plate is pivotally mounted to the housing.

9. An apparatus for comminuting and chipping waste material according to claim 8 wherein the tool is substantially cylindrical.

10. An apparatus for comminuting and chipping waste material according to claim 1 wherein the rib is mounted obliquely on a sector of the disk.

11. An apparatus for comminuting and chipping waste material according to claim 10 wherein the tool comprises at least two disks mounted to the shaft and spaced from each other, each of which has a rib mounted obliquely on a sector of the respective disks, one of said ribs being mounted obliquely in a direction opposite to the other of said ribs.

* * * * *